US009074428B2

(12) United States Patent
Lavagna

(10) Patent No.: US 9,074,428 B2
(45) Date of Patent: Jul. 7, 2015

(54) CONNECTOR FOR STEEL CATENARY RISER TO FLEXIBLE LINE WITHOUT STRESS-JOINT OR FLEX-JOINT

(75) Inventor: Philippe Daniel Richard Lavagna, Monaco (FR)

(73) Assignee: Seahorse Equipment Corp, Houston, TX (US)

( * ) Notice: Subject to any disclaimer, the term of this patent is extended or adjusted under 35 U.S.C. 154(b) by 331 days.

(21) Appl. No.: 13/050,054

(22) Filed: Mar. 17, 2011

(65) Prior Publication Data

US 2011/0226484 A1 Sep. 22, 2011

Related U.S. Application Data

(60) Provisional application No. 61/315,621, filed on Mar. 19, 2010.

(51) Int. Cl.
*E21B 17/01* (2006.01)

(52) U.S. Cl.
CPC ..... *E21B 17/015* (2013.01); *E21B 17/012* (2013.01)

(58) Field of Classification Search
USPC ..... 166/338, 341, 344–346, 350–352, 367, 166/378–380; 441/3–5
See application file for complete search history.

(56) References Cited

U.S. PATENT DOCUMENTS

| | | | | |
|---|---|---|---|---|
| 3,143,172 | A * | 8/1964 | Wakefield, Jr. | 166/352 |
| 4,717,287 | A * | 1/1988 | Laursen | 405/169 |
| 5,269,629 | A * | 12/1993 | Langner | 405/195.1 |
| 5,615,977 | A * | 4/1997 | Moses et al. | 405/195.1 |
| 5,639,187 | A * | 6/1997 | Mungall et al. | 405/195.1 |
| 5,641,248 | A * | 6/1997 | Arlt, III | 405/195.1 |
| 6,206,742 | B1 * | 3/2001 | Bull et al. | 441/1 |
| 6,347,912 | B1 * | 2/2002 | Thomas | 405/224.2 |
| 6,364,021 | B1 * | 4/2002 | Coats | 166/350 |
| 6,386,798 | B2 * | 5/2002 | Finn | 405/224.2 |
| 7,472,755 | B2 | 1/2009 | Riggs | |
| 7,591,316 | B2 * | 9/2009 | Hatton | 166/355 |
| 7,918,283 | B2 * | 4/2011 | Balkanyi et al. | 166/344 |
| 2004/0156684 | A1 * | 8/2004 | Pionetti | 405/224.2 |
| 2006/0070741 | A1 * | 4/2006 | Pollack et al. | 166/345 |
| 2011/0176125 | A1 * | 7/2011 | Smith et al. | 356/32 |

* cited by examiner

*Primary Examiner* — James G Sayre
(74) *Attorney, Agent, or Firm* — Wong, Cabello, Lutsch, Rutherford & Brucculeri, LLP

(57) ABSTRACT

A flexible element in a basket-like structure supports a Steel Catenary Riser (SCR) on a subsurface buoy or "artificial seabed." A riser collar transfers the tension load of riser to a compressive load on the radial bearing. Relative motion between the subsurface buoy and the riser is accommodated by the flexible element. A flexible jumper is connected to the riser for fluid transfer. Motions of the riser relative to the subsurface buoy are accommodated by the flexible jumper. In this way, a transition from an SCR to a flexible jumper may be accomplished without the need for either a stress-joint or a flex-joint.

17 Claims, 3 Drawing Sheets

CONNECTOR FOR STEEL CATENARY RISER TO FLEXIBLE LINE WITHOUT STRESS-JOINT OR FLEX-JOINT

CROSS-REFERENCE TO RELATED APPLICATIONS

This application claims the benefit of U.S. Provisional Application No. 61/315,621 filed Mar. 19, 2010.

STATEMENT REGARDING FEDERALLY SPONSORED RESEARCH OR DEVELOPMENT

Not Applicable

BACKGROUND OF THE INVENTION

1. Field of the Invention

This invention relates to offshore petroleum production. More particularly, it relates to the connection of subsea steel catenary risers to floating production, storage and offloading vessels (FPSO's) and the like.

2. Description of the Related Art Including Information Disclosed Under 37 CFR 1.97 and 1.98.

A riser is a pipe or assembly of pipes used to transfer produced fluids from the seabed to the surface facilities or to transfer injection fluids, control fluids or lift gas from the surface facilities and the seabed. An SCR (Steel Catenary Riser) is a deepwater steel riser suspended in a single catenary from a platform (typically a floater) and connected horizontally on the seabed.

In ultra deepwater, riser systems become a technical challenge and a major part of the field development costs. Large external pressures in these great depths cause flexible solutions to run into weight and cost problems. These same depths however enable steel pipe configurations to maintain curvatures that cause little bending and thus make them suitable for deepwater SCR use.

U.S. Pat. No. 7,472,755 to Riggs discloses a method for servicing a component of a riser system, such as a flexible joint. The riser system may be supported in a support apparatus such that the flexible joint and an adjoining section of riser are detached to allow for inspection, servicing, repair, and/or replacement of the flexible joint or various subcomponents thereof. An apparatus is also disclosed for supporting the flexible joint during servicing.

The steel catenary riser (SCR) concept has recently been used in almost every new deepwater field development around the world. Perhaps the first implementation of the SCR concept occurred in 1994 on the Shell Oil Company's "Auger" tension leg platform (TLP) in 872 m (2860 ft) water depth. Since then, SCR's have been vital to deepwater field developments. Their use has given a new dimension to oil exploration and transportation in water depths where other riser concepts could not tolerate the environmental loads or would have become very costly. SCR designs are very sensitive to floating support platform or vessel motion characteristics to which they are typically attached. In addition to pipe stresses, the main design issue for the SCR concept is fatigue related. There are two main sources for fatigue: random wave fatigue and vortex-induced vibration (VIV) fatigue. The former is due to wave action and the associated platform motion characteristics. The VIV fatigue is mainly due to current conditions.

In the past, an FPSO having a large displacement has typically been used to carry a large number of these deepwater SCR's. Concerns relating to SCR bending fatigue in this use have been addressed and shown not to be a problem in mild environments.

In less benign metocean conditions, a Buoyancy Supported Riser System (BSR) and Sub-Surface Buoy (SSB) may be used to locate the upper terminus of the SCR below the zone affected by wind and waves. In this way, overall motion of the SCR is reduced, leading to decreased wear and metal fatigue.

BRIEF SUMMARY OF THE INVENTION

A flexible element in a basket-like structure supports a Steel Catenary Riser (SCR) on a subsurface buoy or artificial seabed. A riser collar transfers the tension load of the riser to a compressive load on a flexible element on the outside of the riser. Motion of the subsurface buoy relative to the riser is accommodated by the flexible element. A flexible jumper is connected to the riser for fluid transfer. Motion of the riser relative to the subsurface buoy is accommodated by the flexible jumper. In this way, a transition from an SCR to a flexible jumper may be accomplished without the need for either a stress-joint or a flex-joint which must additionally function as a pressure boundary.

BRIEF DESCRIPTION OF THE SEVERAL VIEWS OF THE DRAWING(S)

DETAILED DESCRIPTION OF THE INVENTION

Figure 1:
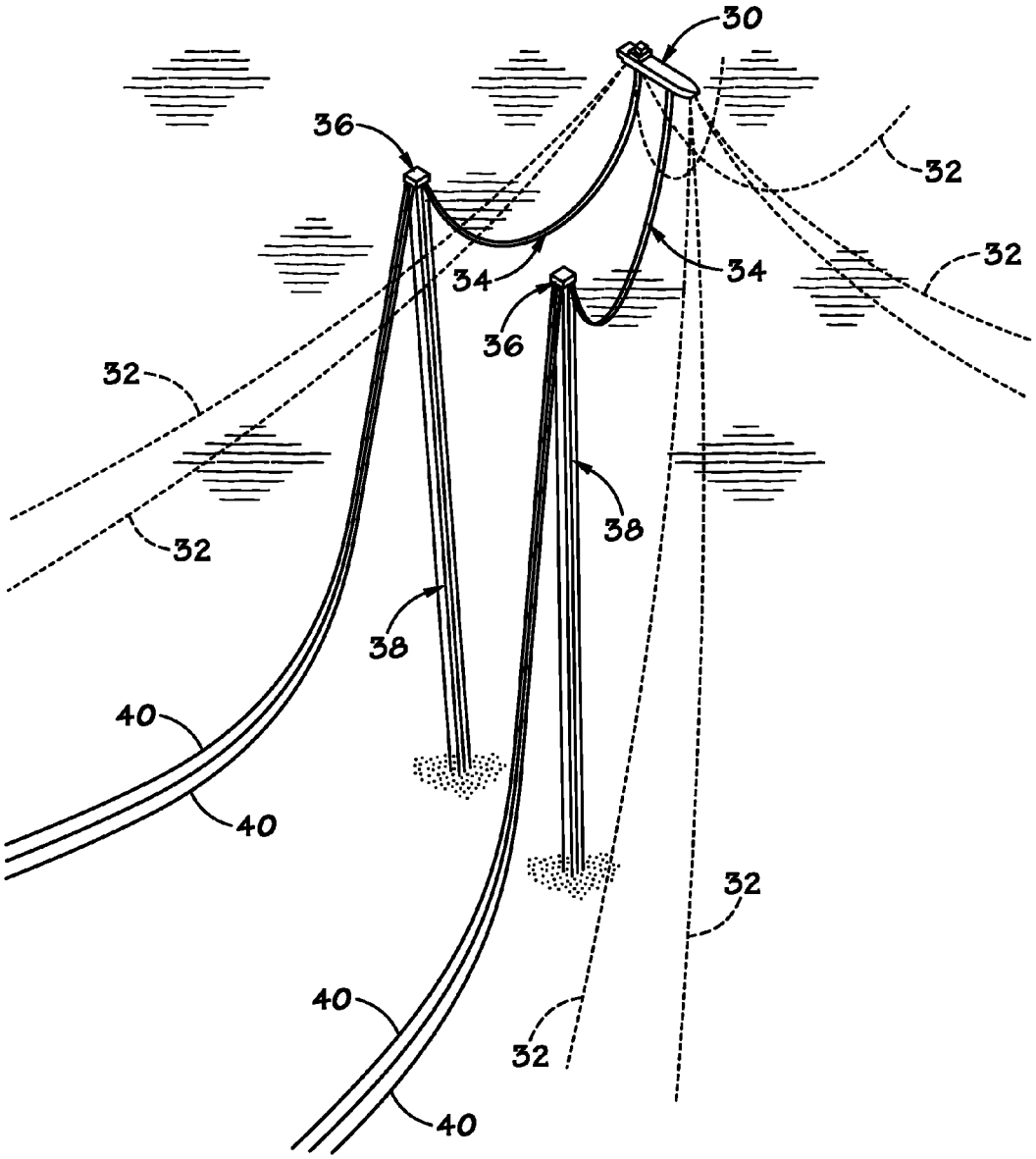
FIG. 1 is a perspective view of a Buoyancy Supported Riser System according to the present invention.

The overall BSR system for a single field location may comprise one or more sub-surface buoys (SSB) with tethers and foundations, the jumpers and its connection systems to the SCR's and the FPSO, the SCR's running down from the SSB to the seabed and extending on a short flowline section and the connection system to allow tie-in of flexible flowlines. Umbilicals may be fully integrated to the decoupled system routed over the SSB.

A Sub-Surface Buoy (SSB) according to the invention may comprise the following systems, as detailed, below.

Structure and Compartments (Hull):

The SSB maybe a rectangular (or square) pontoon type structure with flat plate construction with rolled corners for ease of fabrication. Compartmentalization should be carefully considered with respect to failure modes, installation and operability. The distribution of compartments should also be carefully determined so as to provide the correct upthrust distribution to balance the pay-loads near where they occur to prevent global bending stresses.

Ballast System:

The buoy may comprise a ballast system to actuate the designated compartments for installation and operational functions. As more risers are installed more of the operational compartments are dewatered. This function is important for the SSB installation and fine tuning of the buoy list angles.

Each compartment may be fitted with a positive isolation preventing burping as the buoy offset and displaces and other pressure/temperature effects.

Hang-off porches (receptacles):

The buoy may also be fitted with SCR's, jumpers, umbilicals and tether (2-off by corner) connection/hang-off porches (receptacles). The receptacles may feature longer baskets/funnels to accommodate higher relative motions related to the installation process (which may be performed with heave-comp winches). These may be integrated into the SSB structure but may also be designed to be removable in certain embodiments. Other important components of the buoy may be designed to be replaceable.

The top face of the buoy may be profiled to optimize the jumper routing and may accommodate jumper over-lengths in the middle of the buoy. Profiled gutters may be used to guide and protect the jumper across the top face of the buoy. These may be fitted with lids to protect against dropped objects.

The mooring system for the SSB may comprise tethers. A tether may be comprised of steel wire with chain lengths at either end. Alternatively, steel tubular tethers may be used. A plurality of tethers may be used on each corner of the buoy.

Bottom Tether Tie Off (Connection):

At the seabed, there may be a bottom tether tie-off assembly which is attached to the lower end of the tether body. The bottom tether tie off may consist of a short length of chain and, at the lower end, a foundation latch may be located, complete with trunnion bearing or rotolatch assemblies.

Top Tether Tie Off (Connection):

Each tether may be connected to the buoy porch via a Top Tether Tie-off. The Top Tether Tie-off provides a robust structural connection while maintaining the ability to adjust buoy list angles and tether tension (during the installation process and also periodically during operation). The Top Tether Tie-off may consist of a short length of chain which is connected to the tether top end. At the top end of the chain section there is connected a Top Tie off Structure. This may be a fabricated frame which incorporates two chain stopper systems to latch and lock the chain when the correct tension is achieved and also to allow chain pulling in controlled steps. The chain (and tether) may be tensioned by a removable chain jacking assembly with appropriate ROV operating interface. At the top end of the frame, a pup-piece may be connected that incorporates a low friction flexible connection element (trunnion bearing or flex-joint).

Foundations:

If two tethers are provided on each corner of the buoy, the spacing between the tethers may be about 5 m. At the seabed, the tethers may be connected to the foundation via the articulating bottom tether tie off (connectors). The base case foundation may be a template structure with driven piles on the corners. This approach has been used on almost all current TLP foundations, is known to offer a high level of integrity and provides flexibility to accommodate a range of geotechnical conditions.

The individual tethers may be connected to dedicated receptacles which can be integrated to the template structure. The template may also have space to accommodate a great deal of ballast weight. The foundation relies mostly on the gravity downforce from the mass of the template, piles, ballast (chain or blocks) and also on the soil skin friction (mainly for extreme loading conditions).

The invention may best be understood by reference to certain illustrative embodiments which are shown in the drawing figures.

FIG. 1 shows a buoyancy supported riser system wherein FPSO 30 is moored with a plurality of catenary anchor lines 32. Jumper lines 34 connect FPSO 30 to subsurface buoys (SSB's) 36 which are held below the sea surface by SSB tethers 38. A plurality of Steel Catenary Risers (SCR's) 40 are supported by each SSB 36. The SCR's are in fluid communication with FPSO 30 via jumpers 34. By way of example, jumpers 34 may be multi-layer flexible piping such as COFLEXIP™.

Figure 2:
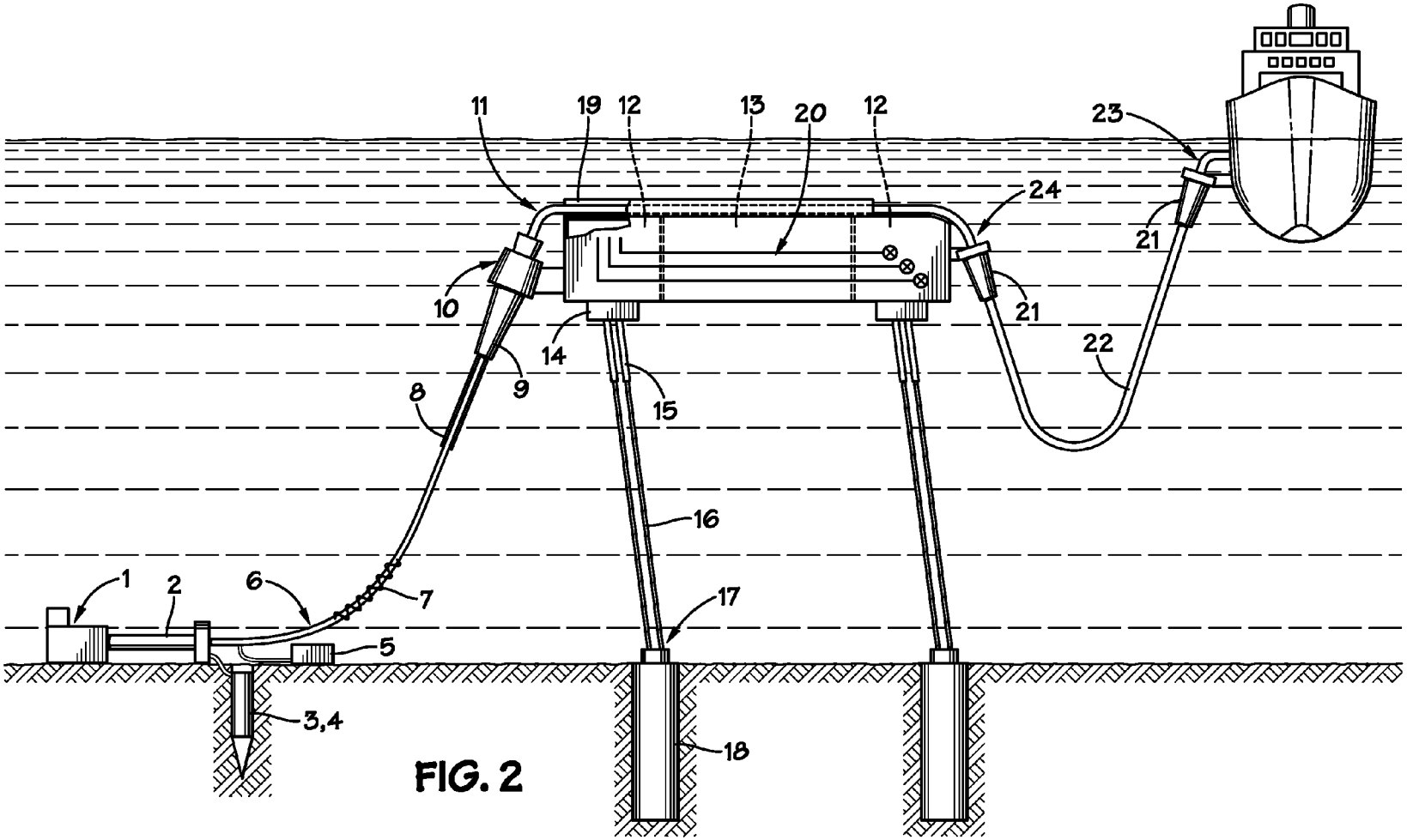
FIG. 2 is a side elevation of a Buoyancy Supported Riser System.

FIG. 2 shows the various components of a buoyancy supported riser system having the following elements:

1. Riser Base Connection System
2. SCR seabed extension (flowline)
3. SCR Anchor
4. Umbilical Anchor
5. Cathodic Protection System
6. SCR—Suspended Section
7. Strakes
8. Coating
9. Flexible Joint or Tapered Stress Joint
10. SCR Hang-off Receptacle
11. Riser Top Connection System
12. SSB operating Compartment
13. SSB Installation Compartment
14. Tether Connection Receptacle
15. Tether Connection System
16. Tether
17. Tether Foundation Connection System
18. Tether Foundation
19. Routing Channels
20. SSB Ballasting Piping/Work Valves
21. Bend Stiffeners
22. Flexible Jumper
23. Connection to FPSO
24. Jumper Hang off Receptacle When considering an ultra deepwater riser system, one method of the prior art is to provide a submerged buoy or artificial seabed to support the steel riser (from the seabed to submerged buoy—artificial seabed) and the flexible jumper (from the submerged buoy—artificial seabed to the floater, e.g., an FPSO). In the practice of this method, some loading conditions may lead to relatively large angle variations between the steel riser and the submerged buoy/artificial seabed structure. For example, when only a few risers are installed, the submerged buoy/artificial seabed may be at a position significantly different than the one it will have when all the risers are installed. Practice of the present invention avoids the need for introducing a flex-joint or a stress-joint element at the steel riser hang-off point that provides a pressure boundary. The flex-joint or stress-joint has the dual function of a "flexible fluid transfer" element, which decouples the flexible fluid transfer function from the flexible structural (i.e. load path) function.

A collar on the steel riser may be connected to an articulation or a rubber flexing element, while the means for fluid transfer remains a rigid steel pipe which is directly connected to the flexible jumper element. The flexible jumper accommodates the offset of the steel riser/flexible jumper connection induced by the riser angle variation around the structural point of flexibility/rotation. As a refinement, in order to avoid the need for a bend stiffener on the jumper side of this connection, a trumpet-type structure may be rigidly connected to the flexible structural element, as illustrated in FIG. 2A. The trumpet acts to limit the bend radius of the flexible element.

Advantages and benefits of the invention over existing systems include the following:

The cost of a flex-joint and/or stress-joint will typically be greater than the extra length of flexible jumper and the steel required for the trumpet. In addition, the decoupling of the functions reduces the risk of failure and/or leaks, especially in the case of the flex-joints.

In FIG. 2A, an enlargement of the structural support between the trumpet for flexible connection and articulation is shown.

Flexible jumper 42 may run along the upper surface of SSB hull 36 and connect to SCR 40 which is supported on SCR porch 44.

Figure 2B:
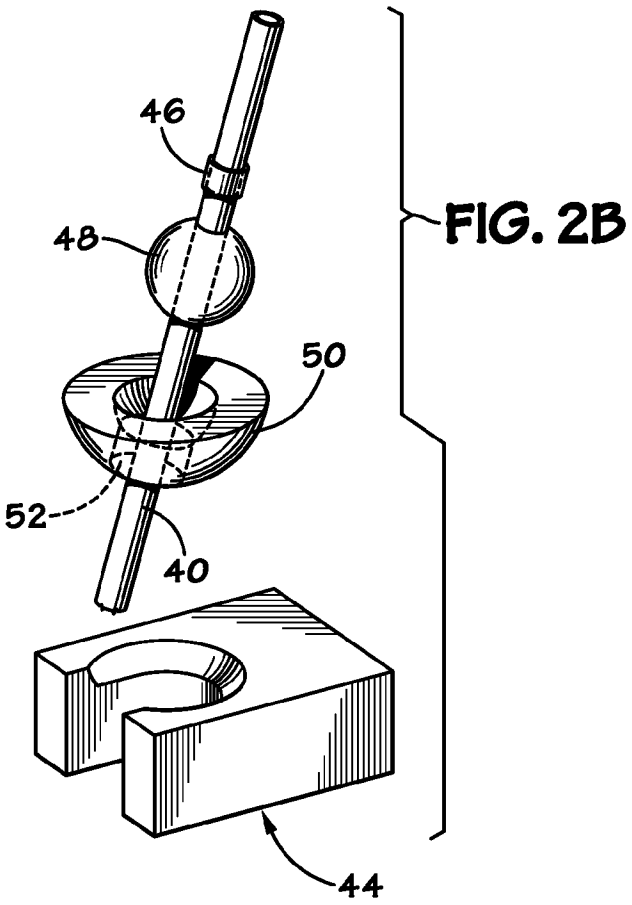
FIG. 2B is an exploded view of the riser support shown in FIG. 2A.
Figure 2A:
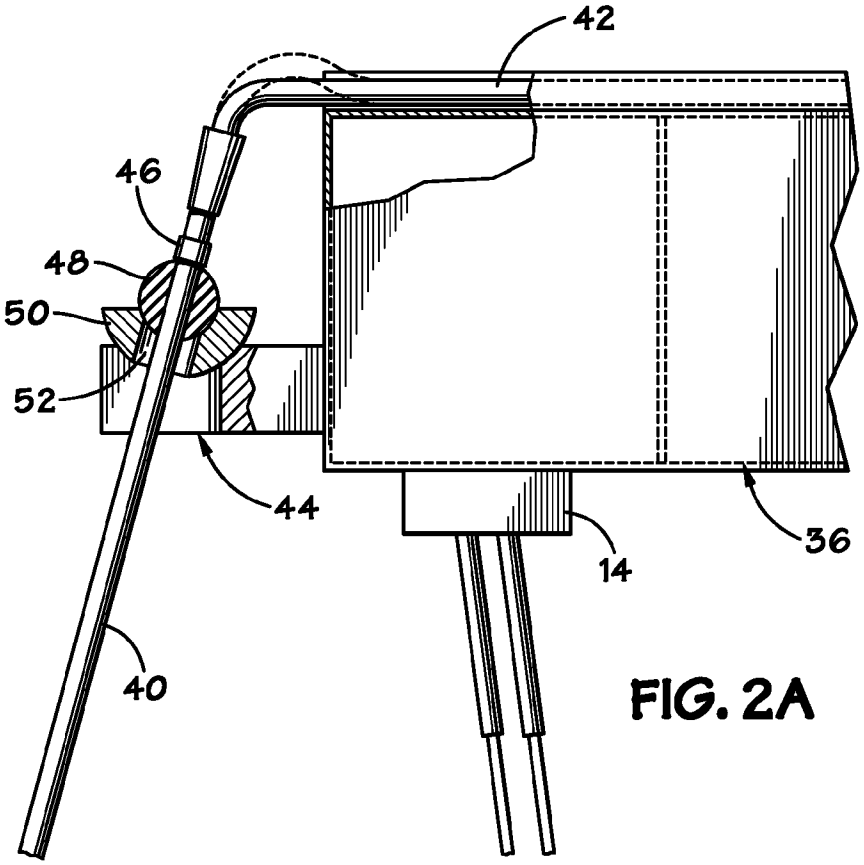
FIG. 2A is an enlargement, partially in cross section of the left portion of the buoy illustrated in FIG. 2.

In the exploded view of FIG. 2B, the riser collar 46 sitting on flexible element 48 in basket 50 is shown. Basket 50 may have a central opening 52 through which SCR 40 may pass. Collar 46 may be attached to or integral with SCR 40. Flexible element 48 also has a central opening through which SCR 40 passes. The tensile load of SCR 40 is transferred as a compressive load to flexible element 48 by collar 46 bearing against the upper surface of radial bearing 48. Flexible element 48 may take many different forms. For example, flexible element 48 may be a generally spherical rubber element. In yet other embodiments, flexible element 48 may comprise one or more laminations of a metal and an elastomer. In still other embodiments, flexible element 48 may comprise one or more laminations of a composite material and an elastomer.

It will be appreciated by those skilled in the art that motion of SCR 40 relative to hull 36 may be accommodated by the resilient nature of flexible element 48 and flexible jumper 42.

Although the invention has been described in detail with reference to certain preferred embodiments, variations and modifications exist within the scope and spirit of the invention as described and defined in the following claims.

What is claimed is:

1. A subsurface buoy comprising:

a buoyant hull;

a riser support structure attached to the hull;

a bearing receptacle attached to the riser support structure the receptacle having a central opening;

a steel catenary riser passing through the opening in the bearing receptacle such that lateral movement of the portion of the riser immediately below the bearing receptacle produces corresponding lateral movement in the opposite direction of the portion of the riser that is above the bearing receptacle;

a flexible element surrounding at least a portion of the riser;

a collar on the riser configured to bear against the flexible element when the riser is loaded in tension; and, a flexible line connected to the upper end of the riser, supported by the hull and in fluid communication with the riser.

2. A subsurface buoy as recited in claim 1 wherein the flexible element is essentially comprised of a generally spherical rubber element having a bore passing through its center sized to accommodate the riser.

3. A subsurface buoy as recited in claim 1 wherein the collar is integral with the riser.

4. A subsurface buoy as recited in claim 1 wherein the central opening in the bearing receptacle has an inside diameter which is about twice the outside diameter of the riser.

5. A subsurface buoy as recited in claim 1 wherein at least a portion of the central opening in the bearing receptacle has a semi-circular longitudinal cross section.

6. A subsurface buoy as recited in claim 5 wherein the portion of the central opening in the bearing receptacle having a semi-circular longitudinal cross section is the upper portion when the bearing receptacle is mounted on the riser support structure.

7. A subsurface buoy as recited in claim 1 wherein the bearing receptacle is generally bowl-shaped.

8. A subsurface buoy as recited in claim 1 further comprising means for limiting the bend radius of the flexible line attached to the hull and in fluid communication with the riser.

9. A subsurface buoy as recited in claim 8 wherein means for limiting the bend radius of the flexible line attached to the hull and in fluid communication with the riser comprises a trumpet.

10. A subsurface buoy as recited in claim 9 wherein means for limiting the bend radius of the flexible line attached to the hull and in fluid communication with the riser comprises a generally cylindrical structure having a frusto-conical central axial bore.

11. A subsurface buoy as recited in claim 1 further comprising channels on the upper surface of the buoy sized and configured to accommodate the flexible lines.

12. A subsurface buoy as recited in claim 11 further comprising a lid covering one or more of the channels.

13. A subsurface buoy as recited in claim 1 further comprising a flexible jumper line having a first end in fluid communication with the flexible line and an opposing second end having means for mechanical and fluid connection to a floating vessel.

14. A subsurface buoy as recited in claim 13 wherein the flexible jumper line is integral with the flexible line.

15. A subsurface buoy as recited in claim 1 wherein the hull is a compartmented hull.

16. A subsurface buoy as recited in claim 15 wherein at least some of the compartments are buoyancy compartments.

17. A subsurface buoy as recited in claim 16 further comprising means for adjusting the buoyancy of the buoyancy compartments.

* * * * *